US011090797B2

(12) United States Patent
Lin

(10) Patent No.: US 11,090,797 B2
(45) Date of Patent: Aug. 17, 2021

(54) FAST ROTATION STRUCTURE OF WRENCH AND WRENCH THEREOF

(71) Applicant: Yu-Chiang Lin, Changhua County (TW)

(72) Inventor: Yu-Chiang Lin, Changhua County (TW)

( * ) Notice: Subject to any disclaimer, the term of this patent is extended or adjusted under 35 U.S.C. 154(b) by 308 days.

(21) Appl. No.: 16/265,982

(22) Filed: Feb. 1, 2019

(65) Prior Publication Data

US 2020/0246960 A1 Aug. 6, 2020

(51) Int. Cl.
*B25G 1/00* (2006.01)
*B25B 23/00* (2006.01)
*B25B 13/46* (2006.01)

(52) U.S. Cl.
CPC ..... *B25G 1/005* (2013.01); *B25B 13/462* (2013.01); *B25B 23/0035* (2013.01)

(58) Field of Classification Search
CPC ..... B25G 1/005; B25G 1/007; B25B 13/462; B25B 23/0035
See application file for complete search history.

(56) References Cited

U.S. PATENT DOCUMENTS 4,611,514 A * 9/1986 Hyde ..... B25B 13/461 81/60
4,748,874 A * 6/1988 Sharp ..... B25B 13/461 81/177.2
5,542,322 A * 8/1996 Knox ..... B25B 13/461 81/177.6
6,095,018 A * 8/2000 Schuster ..... B25G 1/007 81/177.5
7,168,345 B1 * 1/2007 Hsieh ..... B25B 13/461 411/403
7,182,003 B1 * 2/2007 Hsieh ..... B25B 13/461 411/403
7,509,892 B2 * 3/2009 Hsieh ..... B25B 13/461 81/177.6
8,869,658 B2 * 10/2014 Chou ..... B25G 1/007 81/177.8
10,513,013 B2 * 12/2019 Huang ..... B25G 1/063
2008/0028899 A1 * 2/2008 Scott ..... B25G 1/007 81/177.7
2017/0274506 A1 * 9/2017 Huang ..... B25G 1/063

* cited by examiner

*Primary Examiner* — David B. Thomas
(74) *Attorney, Agent, or Firm* — Muncy, Geissler, Olds & Lowe, P.C.

(57) ABSTRACT

A fast rotation structure of wrench and wrench thereof are provided. The rotation structure includes a seat connected with the ratchet head of the wrench. The seat has a first pivot connection portion which is pivotally connected with a second pivot connection portion of a rocker arm, such that the rocker arm sways between a folding position and a driving position. At the folding position, the rocker arm is combined with the seat. At the driving position, the rocker arm protrudes from one side of the seat, so as to drive the seat to rotate from an outer side of the seat. Therefore, the ratchet head is able to efficiently rotate.

8 Claims, 8 Drawing Sheets

FAST ROTATION STRUCTURE OF WRENCH AND WRENCH THEREOF

BACKGROUND OF THE INVENTION

1. Field of the Invention

The present invention relates to rotation structures of wrench, and more particularly, to a fast rotation structure of wrench for fast rotating the ratchet head.

2. Description of the Related Art

In the industry, a wrench having a ratchet head is applied for rotating the rotation member (screw or nut) to be fastening or loosening the rotation member. By use of the unidirectional driving function of the wrench, when driving the rotation member, the user does not need to repeatedly combine the wrench and the rotation member, improving the operation efficiency.

However, regarding a conventional wrench, when the rotation member is combined with the object with almost no resistance force existing between the rotation member and the object, when the sleeve of the wrench is combined with the rotation member for carrying out the rotation motion, the unidirectional rotation of the wrench with respect to the rotation member is prevented. As a result, the rotation member will rotate forward and backward altogether with the rotation of the wrench. Therefore, when the user wishes to continue the rotation of the rotation member with respect to the object, the user will usually rotate the rotation member by a bare hand. However, before rotating the rotation member by hand, the user needs to separate the wrench from the rotation member. In other words, the user is unable to finish the rotation operation of the rotation member by use of only the wrench, causing the inconvenience of driving the rotation member with the wrench and a lower operation efficiency.

Therefore, the solution for the issues above is needed as an objective of the present invention.

SUMMARY OF THE INVENTION

For improving the issues above, a fast rotation structure of wrench and the wrench thereof are disclosed. With a rocker arm connected to one side of the seat, the rocker arm is able to pivot between a folding position and a driving position, wherein the rocker arm is applied for driving the seat to rotate at the driving position, so as to fast rotate the ratchet head which is linked with the seat.

For achieving the aforementioned objectives, a fast rotation structure of wrench is provided for fast rotating the ratchet head of the wrench. The fast rotation structure comprises:

a seat having a predetermined height and a first pivot connection portion at one side of the seat, the seat being connected with the ratchet head;

a rocker arm having a second pivot connection portion at one side of the rocker arm, the second pivot connection portion being pivotally connected with the first pivot connection portion in an axial orientation which is arrange in vertical with respect to the height direction of the seat, the rocker arm being able to be lifted in an axial direction to sway between a folding position and a driving position; at the folding position, the rocker arm being combined with the seat; at the driving position, the rocker arm protruding at one side of the seat for driving the seat to rotate from an outer side of the seat.

For achieving the aforementioned objectives, a wrench having a fast rotation structure is provided, comprising:

a wrench having a driving end, with a ratchet head disposed at the driving end;

a seat having a predetermined height and a first pivot connection portion at one side of the seat, the seat being connected with the ratchet head;

a rocker arm having a second pivot connection portion at one side, the second pivot connection portion being pivotally connected with the first pivot connection portion in an axial alignment which is in vertical with respect to a height direction of the seat, the rocker arm being able to be lifted in an axial direction to sway between a folding position and a driving position; at the folding position, the rocker arm being combined with the seat; at the driving position, the rocker arm protruding at one side of the seat for driving the seat to rotate from an outer side of the seat.

With such configuration, when the rotation member is combined with an object with almost no resistance force existing between the rotation member and the object, the rocker arm is moved to the driving position, so as to drive the seat to rotate by use of the rocker arm, thus fast rotating the ratchet head for fast rotating the rotation member which is rotationally disposed on the object. The rotational fastening or loosening operation of the rotation member with respect to the object is able to be finished without the need of separating the wrench from the rotation member, facilitating the convenience of driving the rotation member with the wrench. Also, a greater efficiency of rotationally fastening or loosening the rotation member is achieved.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 8, a fast rotation structure of wrench in accordance with an embodiment of the present invention comprises a wrench 10, a seat 20, and a rocker arm 30.

Figure 6:
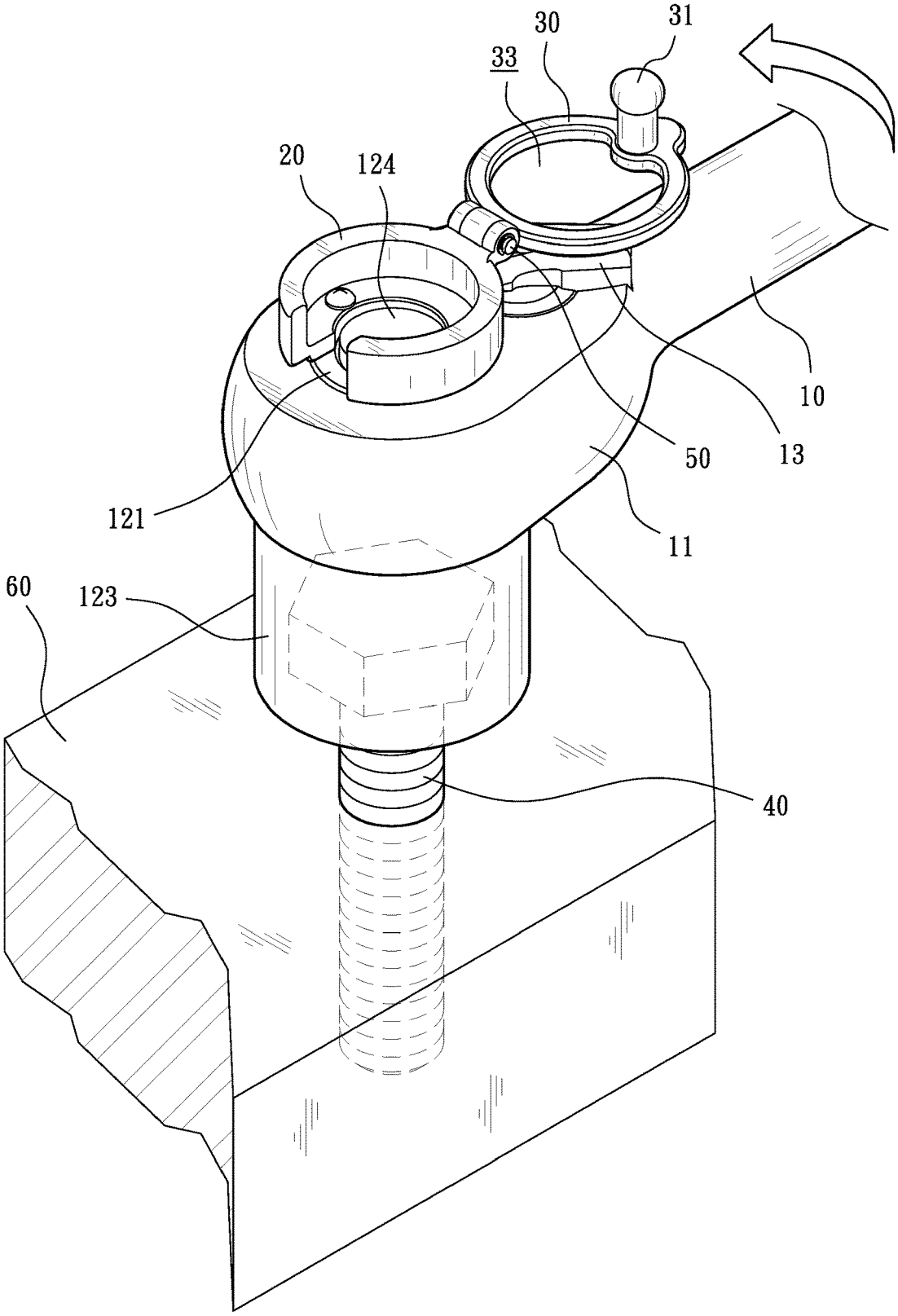
FIG. 6 is a schematic view illustrating the wrench in accordance with an embodiment of the present invention driving the rotation member counterclockwise with the sleeve.
Figure 8:
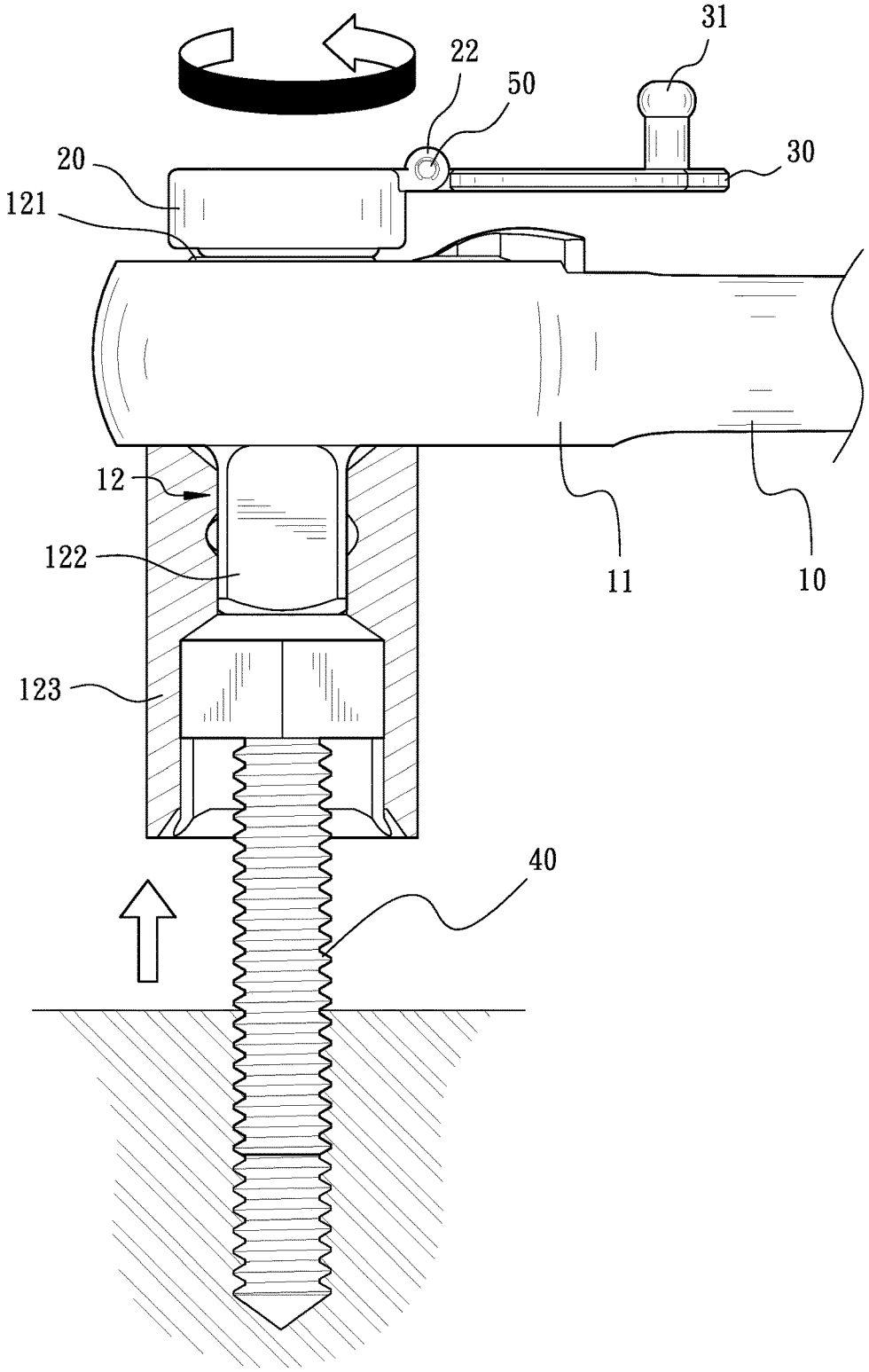
FIG. 8 is a schematic view illustrating the seat rotating to driven the screw to rotate upward with the sleeve.

The wrench 10 has a driving end 11, with a ratchet head 12 disposed at the driving end 11. In an embodiment of the present invention, the ratchet head 12 has a main body 121 disposed at the driving end 11 and an operation portion 122 extending from one side of the driving end 11. The main body 121 is engaged by ratchet teeth (now shown) in the driving end 11 to be rotatable in a single direction. The operation portion 122 is connected with a sleeve 123 for combining the rotation member (as shown by FIG. 6 and FIG. 8), wherein the rotation member is, for example but not limited to, a screw 40 or a nut.

In an embodiment of the present invention, the ratchet head 12 has a press button 124 disposed at the center thereof. When the sleeve 123 received by the operation portion 122 is to be released, the press button 124 is pressed for detaching the sleeve 123 from the operation portion 122. Also, in an embodiment of the present invention, the wrench 10 is a bidirectional driving wrench, which has a switch 13 which is switchable between the center position and two sides thereof, whereby the wrench 10 is able to be unidirectionally rotate clockwise or counterclockwise. Nevertheless, such wrench 10 is only for illustrating the technical features of the present invention, thus not limited to the aforementioned bidirectional driving wrench. A unidirectional driving wrench is also in the claim scope of the present invention.

Figure 1:
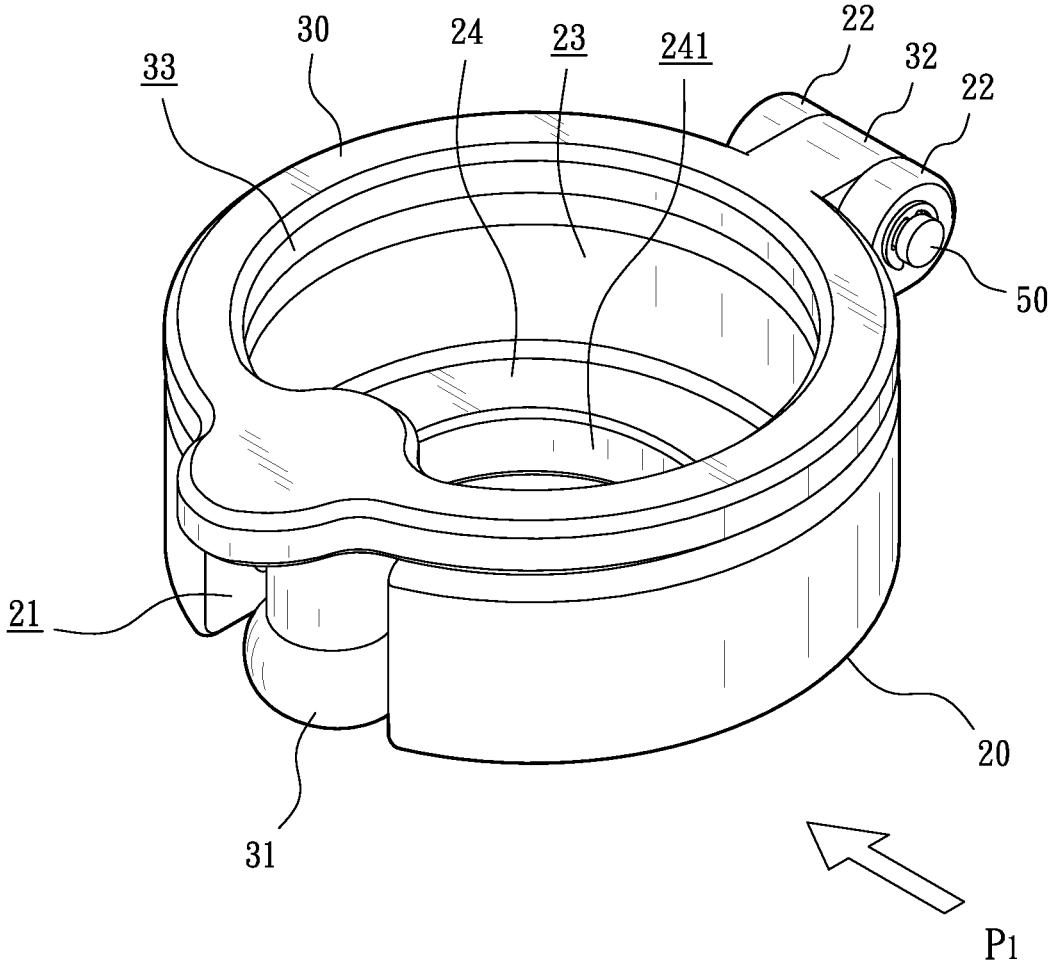
FIG. 1 is a perspective view of the fast rotation structure in accordance with an embodiment of the present invention, wherein the seat and the rocker arm are at the folding position.
Figure 2:
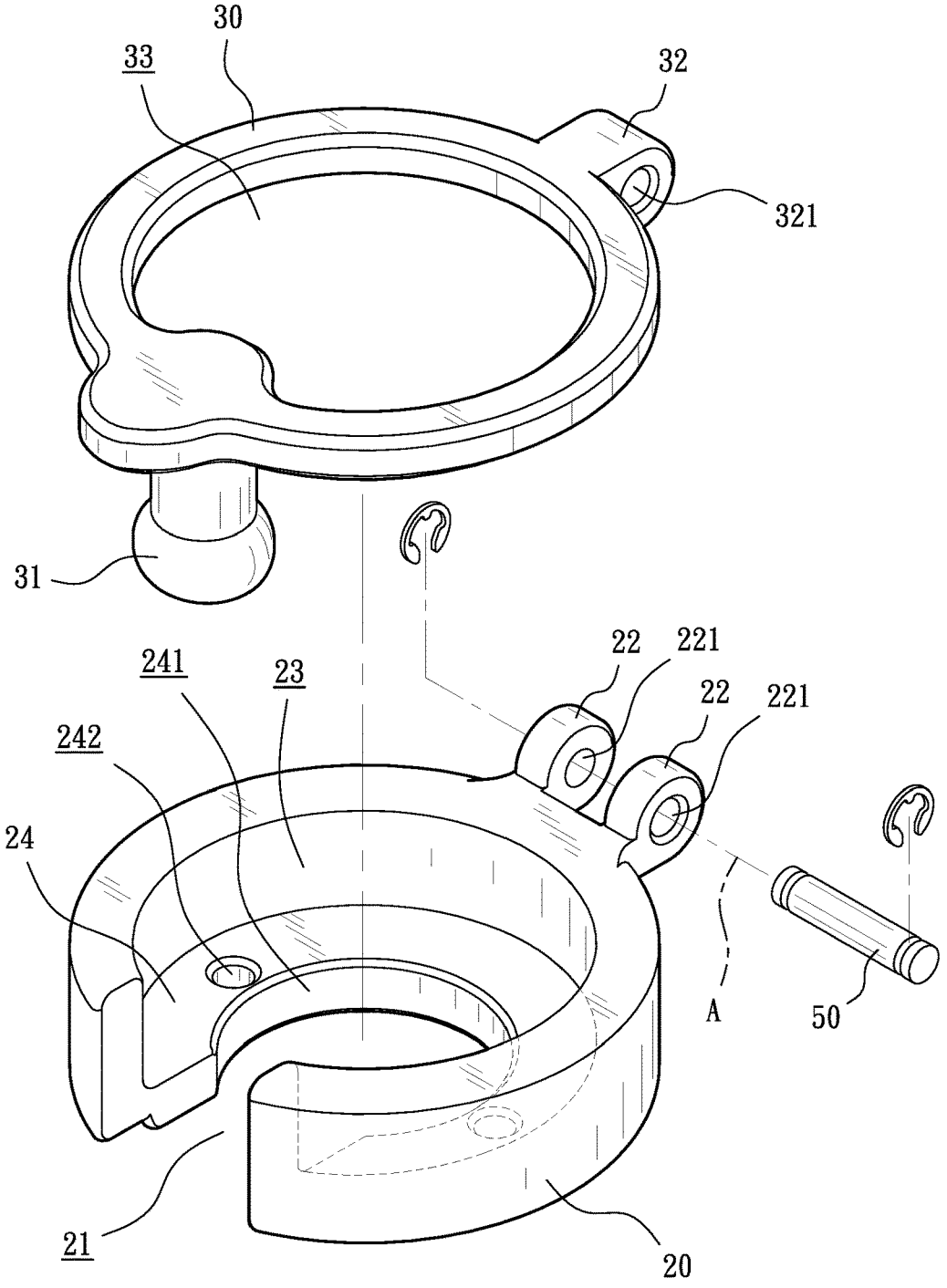
FIG. 2 is an exploded view illustrating the combination between the seat and the rocker arm
Figure 3:
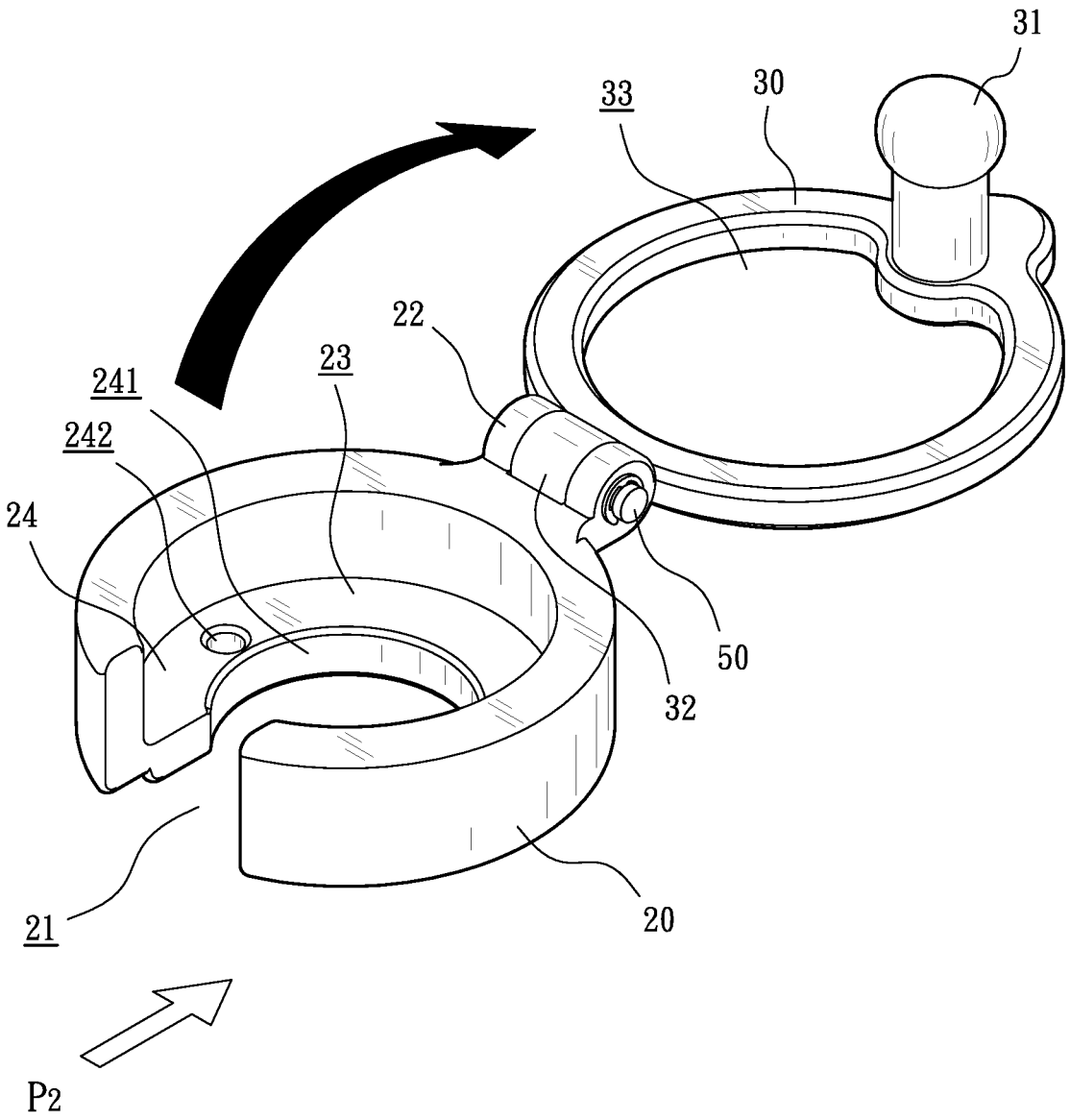
FIG. 3 is a perspective view of the rotation structure, wherein the seat and the rocker arm are at the driving position.
Figure 4:
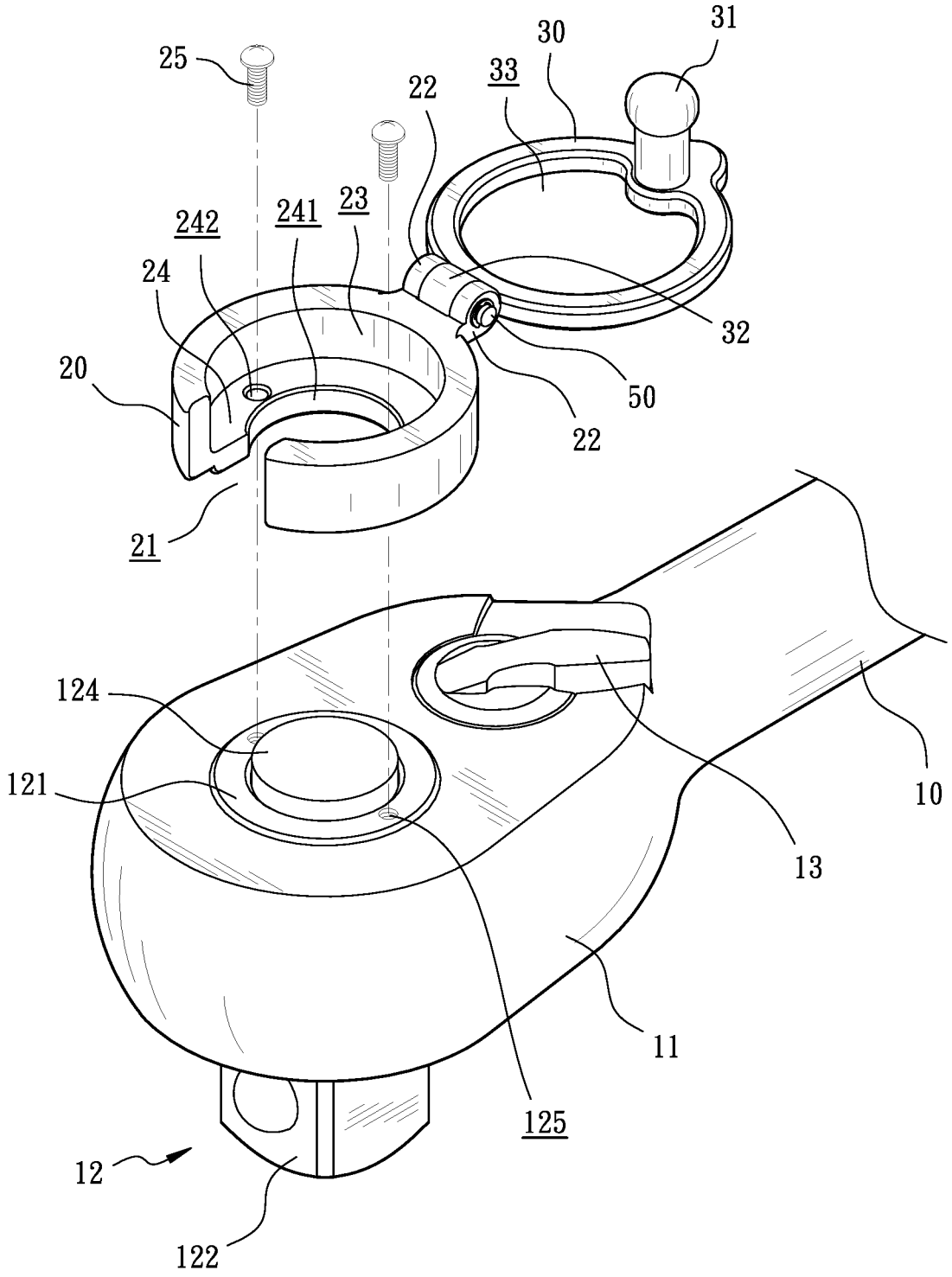
FIG. 4 is a schematic view illustrating the fast rotation structure being combined with a wrench.
Figure 5:
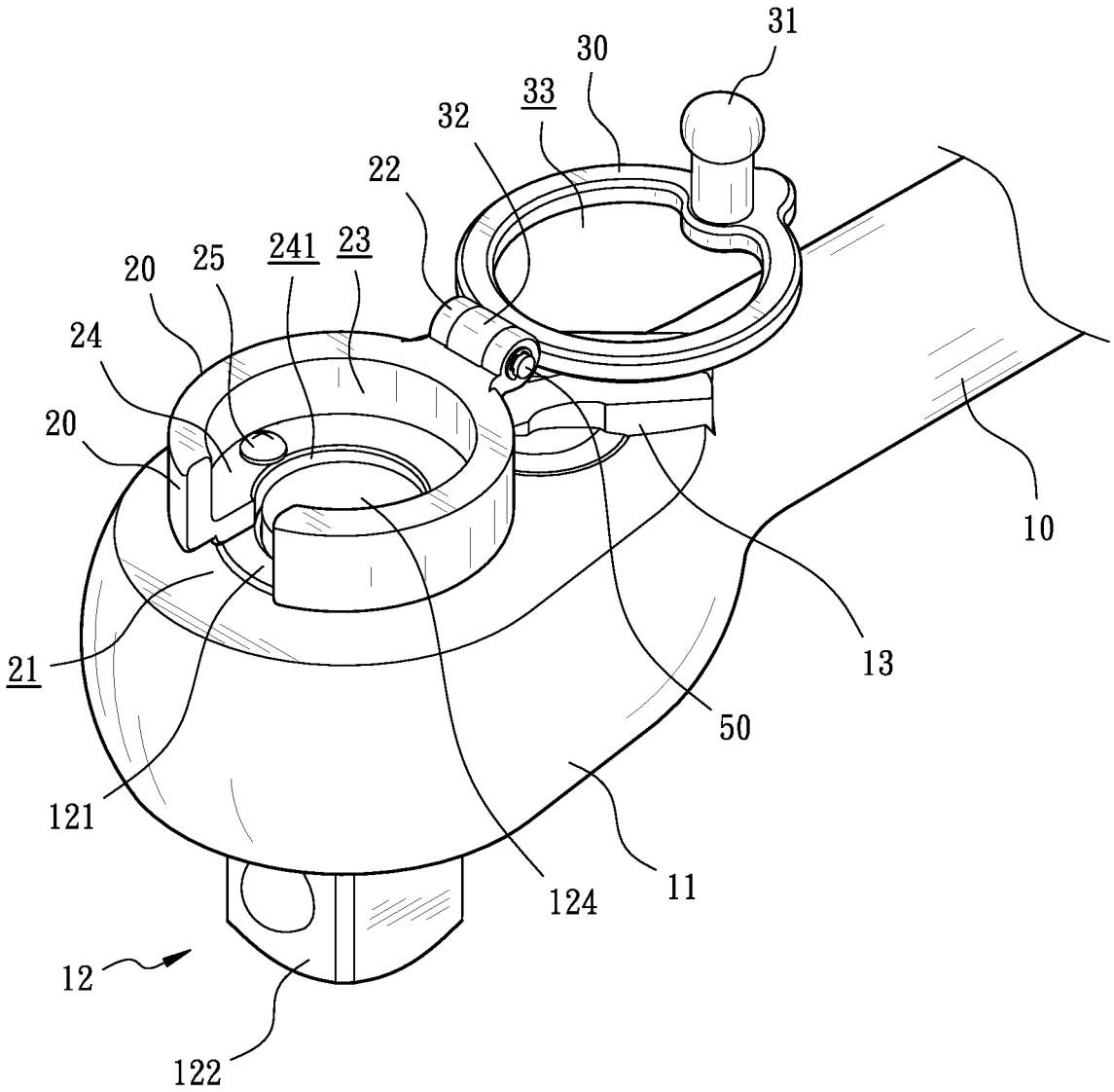
FIG. 5 is another schematic view illustrating the fast rotation structure being combined with a wrench.

The seat 20 is connected with the ratchet head 12. The seal 20 has a predetermined height. The seat 20 has a first pivot connection portion on one side thereof, and the rocker arm 30 has a second pivot connection portion on one side thereof. The second pivot connection portion and the first pivot connection portion are pivotally connected along an axial direction A, which is arranged in vertical to the height direction of the seat 20. The rocker arm 30 is allowed to be lifted along the axial direction A, and is able to waver between a folding position P1 and a driving position P2 with respect to the seat 20 (as shown by FIG. 1 and FIG. 3). At the folding position P1, the rocker arm 30 overlaps the seat 20. At the driving position P2, the rocker arm 30 protrudes from one side of the seat 20 for driving the seat 20 to rotate from the outer side of the seat 20.

In an embodiment of the present invention, the seat 20 is formed in a column shape, and the rocker arm 30 is formed in a corresponding circular shape. The rocker arm 30 has a rocker handle 31 disposed on a side in opposite to the second pivot connection portion. At the driving position P2, the rocker handle 31 protrudes on the rocker arm 30. The seat 20 has an opening 21 disposed on a side in opposite to the first pivot connection portion. At the folding position P1, the rocker arm 30 is received in the opening 21. In an embodiment of the present invention, the seat 20 has two symmetrically disposed pivot members 22 on one side thereof, wherein each pivot member 22 has a coaxially formed first axle bore 221.

In an embodiment of the present invention, the second pivot connection portion is a pivot block 32 disposed on one side of the rocker arm 30. The pivot block 32 has a second axle bore 321 and is arranged between the two pivot members 22, such that the pivot block 32 and the two pivot members 22 are arranged in alignment, whereby the two first axle bores 221 and the second axle bore 321 are arranged in axial alignment, with an axle member 50 passing through the two first axle bores 221 and the second axle bore 321 for pivotally connecting the two pivot members 22 and the pivot block 32.

In an embodiment of the present invention, the rocker arm 30 is formed in a circular ring shape and provided with a through bore 33. The seat 20 has a recess 23 which is connected with the through bore 33 at the folding position P1. The seat 20 has a bottom plate 24 at the top portion of the recess 23, and the bottom plate 24 is removably combined with the ratchet head 12. More particularly, a through hole 241 is formed at the center of the bottom plate 24, and the through hole 241 is connected with the recess 23. Also, one side of the through hole 241 is connected with the opening 21. The bottom plate 24 further has two apertures 242 disposed on two sides of the through hole 241, respectively. In an embodiment of the present invention, the ratchet head 12 has two lock holes 125 disposed on the main body 121 corresponding to the two apertures 242, such that the bottom plate 24 is allowed to be fastened on the two lock holes 125 by two fasteners 25 (such as screws in the embodiment) passing through the two apertures 242, respectively. Meanwhile, the press button 124 is exposed from the through hole 241.

Figure 7:
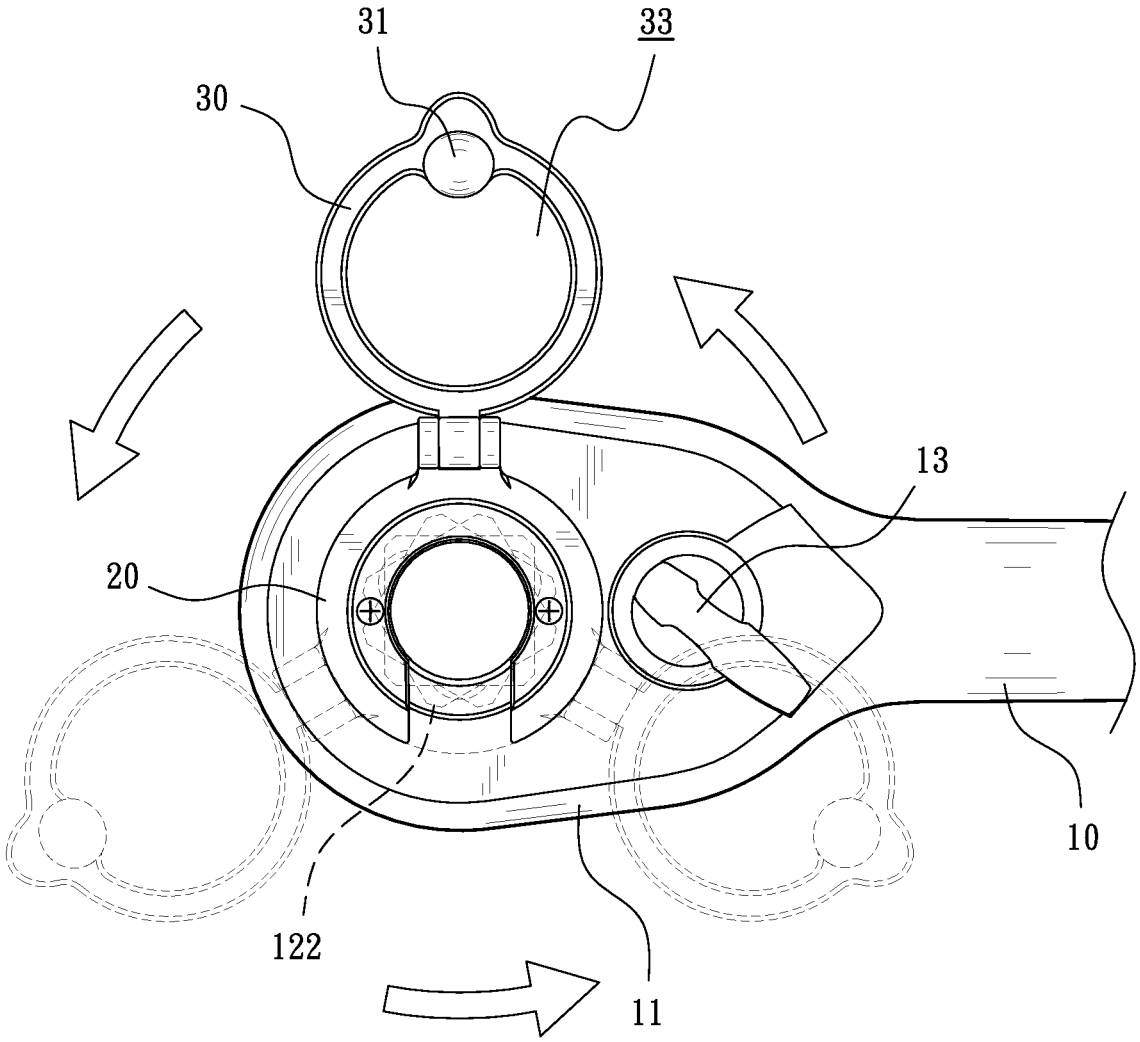
FIG. 7 is a top schematic view illustrating the seat driven by the rocker arm to rotate counterclockwise.

During the operation of the fast rotation structure of wrench, when a screw 40 fastened on the object 60 is to be removed, based on the fact that the screw 40 is still in a fastened status, a sleeve 123 with a size corresponding to the size of the screw 40 is installed on the operation portion 122 of the ratchet head 12, and then mounted on the screw 40. Next, as shown by FIG. 6, the wrench 10 is wrenched in a counterclockwise direction for unidirectionally driving the fastened screw 40 to be loosened with respect to the object 60. When the screw 40 is released to an approximately free status, the screw 40 will rotate back and forth altogether with the rotation of the wrench 10. Therefore, the rocker arm 30 is lifted from the folding position FI on the seat 20 to the driving position P2, and the rocker handle 31 is gripped to drive the operation portion 122 to rotate in a counterclockwise direction by the rocker arm 30 (as shown by FIG. 7). Alternatively, the user is able to twist the rocker arm 30 by placing a finger into the through bore 33 (not shown). With such operations, the screw 40 is driven to continuously rotate upward by the sleeve 123 (as shown by FIG. 8), so as to be removed from the object 60.

On the other hand, when the screw 40 is to be fastened onto the object 60, the sleeve 123 is mounted on the screw 40 which is placed on the object 60, and the operation portion 122 is driven in a clockwise direction, such that the sleeve 123 forces the screw 40 to rotate to reach a tightness between the screw 40 and the object 60. Next, the wrench 10 is driven to continuously rotate in a clockwise direction, whereby the screw 40 on the object 60 is unidirectionally driven to be fastened.

With the foregoing configuration, advantages achievable by the present invention will be illustrated below.

When there is almost no resistance force existing between the screw 40 and the object 60 on which the screw 40 is disposed, the user is unable to drive the screw 40 to unidirectionally rotate by simply rotating the wrench 10. Therefore, the user applies the rocker arm 30 which is at the driving position P2 on the seat 20 to drive the rotation of the seat 20, so that the ratchet head 12 is driven to rotate, whereby the screw 40 is accordingly rotated with respect to the object 60. In other words, the user is able to finish the releasing or fastening operation of the screw 40 without the need of separating the sleeve 123 from the screw 40. Therefore, the driving operation of the screw 40 by use of the wrench 10 is facilitated, and the rotation operation efficiency of the screw 40 with respect to the object 60 is improved.

Also, regarding the wrench 10 in accordance with an embodiment of the present invention, a switch 13 is disposed adjacent to the ratchet head 12 at the driving end 11, because of a predetermined height of the seat 20, when the rocker arm 30 is at the driving position P2, the rocker arm 30 is prevented from contacting the switch 13, facilitating a smooth rotation of the rocker arm 30.

Besides operating the rocker handle 31 of the rocker arm, the user is also able to twist the rocker arm 30 around by placing a finger into the through bore 33 of the rocker arm 30, so as to drive the rocker arm 30 in an alternative method, facilitating the convenience of driving the rocker arm 30.

Notably, in the embodiments above, the seat 20 and the ratchet head 12 are two different components that are fastened to be combined. However, the seat 20 and the ratchet head 12 are also allowed to be integrally formed, such that the connection between the seat 20 and the ratchet head 12 remains.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A fast rotation structure of wrench for fast rotating a ratchet head of a wrench, comprising:

a seat having a predetermined height and a first pivot connection portion at one side of the seat, the seat being connected with the ratchet head;

a rocker arm having a second pivot connection portion at one side, the second pivot connection portion being pivotally connected with the first pivot connection portion in an axial alignment which is in vertical with respect to a height direction of the seat, the rocker arm being able to be lifted in an axial direction to sway between a folding position and a driving position; at the folding position, the rocker arm being combined with the seat at the driving position, the rocker arm protruding at one side of the seat for driving the seat to rotate from an outer side of the seat;

wherein the seat is formed in a column shape, and the rocker arm is formed in a corresponding circular shape; the rocker arm has a rocker handle disposed on a side in opposite to the second pivot connection portion; at the driving position, the rocker handle protrudes on the rocker arm; the seat has an opening formed on a side in opposite to the first pivot connection portion, such that the rocker arm is received in the opening when being at the folding position.

2. The rotation structure of claim 1, wherein the rocker arm is formed in a circular ring shape and has a through bore; the seat has a recess which is connected with the through bore at the folding position; the seat has a bottom plate at a top portion of the recess, and the bottom plate is removably combined with the ratchet head.

3. The rotation structure of claim 2, wherein a through hole is formed at a center portion of the bottom plate, and the through hole is connected with the recess; one side of the through hole is connected with the opening; the bottom plate has two apertures disposed on two sides of the through hole, respectively, and the ratchet head has two lock holes disposed on the main body corresponding to the two apertures, such that the bottom plate is fastened on the two lock holes with two fasteners passing through the two apertures, respectively.

4. The rotation structure of claim 1, wherein the first pivot connection portion is two symmetrically disposed pivot members on one side of the seat, and each of the two pivot members has a first axle bore, and the two first axle bores are arranged in an axial alignment; the second pivot connection portion is a pivot block disposed on one side of the rocker arm, and the pivot block has a second axle bore, such that the pivot block and the two pivot members are arranged in alignment, whereby the two first axle bores and the second axle bore are arranged in an axial alignment, with an axle member passing through the two first axle bores and the second axle bore for pivotally connecting the two pivot members and the pivot block.

5. A wrench having a fast rotation structure, comprising:

a wrench having a driving end, with a ratchet head disposed at the driving end;

a seat having a predetermined height and a first pivot connection portion at one side of the seat, the seat being connected with the ratchet head;

a rocker arm having a second pivot connection portion at one side, the second pivot connection portion being pivotally connected with the first pivot connection portion in an axial alignment which is in vertical with respect to a height direction of the seat, the rocker arm being able to be lifted in an axial direction to sway between a folding position and a driving position; at the folding position, the rocker arm being combined with the seat at the driving position, the rocker arm protruding at one side of the seat for driving the seat to rotate from an outer side of the seat;

wherein the seat is formed in a column shape, and the rocker arm is formed in a corresponding circular shape; the rocker arm has a rocker handle disposed on a side in opposite to the second pivot connection portion; at the driving position, the rocker handle protrudes on the rocker arm; the seat has an opening formed on a side in opposite to the first pivot connection portion, such that the rocker arm is received in the opening when being at the folding position.

6. The wrench of claim 5, wherein the rocker arm is formed in a circular ring shape and has a through bore; the seat has a recess which is connected with the through bore at the folding position; the seat has a bottom plate at a top portion of the recess, and the bottom plate is removably combined with the ratchet head.

7. The wrench of claim 6, wherein a through hole is formed at a center portion of the bottom plate, and the through hole is connected with the recess; one side of the through hole is connected with the opening; the bottom plate has two apertures disposed on two sides of the through hole, respectively, and the ratchet head has two lock holes disposed on the main body corresponding to the two apertures, such that the bottom plate is fastened on the two lock holes with two fasteners passing through the two apertures, respectively.

8. The wrench of claim 5, wherein the first pivot connection portion is two symmetrically disposed pivot members on one side of the seat, and each of the two pivot members has a first axle bore, and the two first axle bores are arranged in an axial alignment; the second pivot connection portion is a pivot block disposed on one side of the rocker arm, and the pivot block has a second axle bore, such that the pivot block and the two pivot members are arranged in alignment, whereby the two first axle bores and the second axle bore are arranged in an axial alignment, with an axle member passing through the two first axle bores and the second axle bore for pivotally connecting the two pivot members and the pivot block.

* * * * *